US006360647B1

(12) United States Patent
Alm et al.

(10) Patent No.: US 6,360,647 B1
(45) Date of Patent: Mar. 26, 2002

(54) HYDRAULIC ROTATING AXIAL PISTON ENGINE

(75) Inventors: Filip Alm, Bohus; Per-Ove Josefsson, Vanersborg, both of (SE)

(73) Assignee: Parker Hannifin AB, Boras (SE)

( * ) Notice: Subject to any disclaimer, the term of this patent is extended or adjusted under 35 U.S.C. 154(b) by 0 days.

(21) Appl. No.: 09/689,470

(22) Filed: Oct. 12, 2000

Related U.S. Application Data

(63) Continuation of application No. PCT/SE99/00587, filed on Apr. 12, 1999.

(30) Foreign Application Priority Data

Apr. 17, 1998 (SE) ..... 9801323-8

(51) Int. Cl.[7] ..... F01B 1/06
(52) U.S. Cl. ..... 91/491; 91/504; 417/269
(58) Field of Search ..... 91/491, 504, 506, 91/505; 92/57, 71, 12.2; 417/269, 273; 475/83

(56) References Cited

U.S. PATENT DOCUMENTS

| | | | | | |
|---|---|---|---|---|---|
| 3,656,409 | A | * | 4/1972 | Thoma et al. | 91/504 |
| 3,722,372 | A | * | 3/1973 | Freese | 91/504 |
| 3,793,924 | A | | 2/1974 | Eickmann | |
| 4,223,594 | A | | 9/1980 | Gherner | |
| 4,271,725 | A | * | 6/1981 | Takao et al. | 475/83 |
| 4,413,548 | A | * | 11/1983 | Klie et al. | 91/491 |
| 4,896,585 | A | * | 1/1990 | Foster | 92/12.2 |
| 4,920,860 | A | | 5/1990 | Alm et al. | |
| 4,934,253 | A | | 6/1990 | Berthold et al. | |
| 4,941,395 | A | * | 7/1990 | Reynolds et al. | 92/57 |
| 4,951,551 | A | * | 8/1990 | Arai et al. | 91/506 |
| 5,176,066 | A | | 1/1993 | Kanamaru et al. | |
| 5,488,894 | A | * | 2/1996 | Schroder | 91/505 |
| 5,626,465 | A | * | 5/1997 | Thoma | 417/273 |
| 5,685,215 | A | * | 11/1997 | Jepsen et al. | 92/71 |
| 6,287,086 | B1 | * | 9/2001 | Steen | 417/269 |

FOREIGN PATENT DOCUMENTS

| | | |
|---|---|---|
| CH | 592 812 | 11/1977 |
| EP | 0 567 805 A1 | 4/1993 |
| SE | 431 897 | 5/1984 |

OTHER PUBLICATIONS

Copy of the International Application Published Under the PCT in Case No. PCT/SE98/02218.
Copy of the International Application Published Under the PCT in Case No. PCT/SE99/00186.
Copy of the International Application Published Under the PCT in Case No. PCT/SE99/00187.
Copy of the International Application Published Under the PCT in Case No. PCT/SE99/00587.

* cited by examiner

*Primary Examiner*—Teresa Walberg
*Assistant Examiner*—Leonid Fastovsky
(74) *Attorney, Agent, or Firm*—Christopher H. Hunter

(57) ABSTRACT

A hydraulic rotating axial piston engine has a housing enclosing a rotatable cylinder barrel. The barrel has a number of axial cylinders with a number of reciprocating pistons. The pistons reciprocate between two defined end positions, and cooperate with an angled plate in order to obtain the reciprocating movement. The cylinder barrel is rotatable relative to a first axis, which is inclined relative to a second axis of an input/output shaft. The housing has two parts, one part of the housing positions the input/out shaft and a second part includes inlet and outlet channels. The rotation of the cylinder barrel and the input/output shaft is synchronized by means of synchronizing means. A central support pin extends along the first axis between the angled plate and the cylinder barrel. The support pin is at one end axially connected with the angled plate, and at the other end axially connected to the cylinder barrel. The support pin limits axial movement at the cylinder barrel relative to the angled plate.

18 Claims, 5 Drawing Sheets

HYDRAULIC ROTATING AXIAL PISTON ENGINE

CROSS REFERENCE TO RELATED APPLICATION

This application is continuation of copending International Application No. PCT/SE99/00587, filed Apr. 12, 1999 which designated the United States, and claims priority to Swedish Patent Application 9801323-8, filed Apr. 17, 1998.

BACKGROUND OF THE INVENTION

From European Patent Reference EP-A1-0 567 805, a hydraulic piston engine is known which has a number of axial cylinders. The cylinders are circumferentially arranged in a rotatable cylinder barrel. Each of the cylinders is provided with a channel, which alternatingly communicates with an inlet port or an outlet port in the end portion of a housing. In order to secure a sealing contact between the cylinder barrel and the housing in the area of the inlet and outlet ports, the cylinder barrel is biased along its rotational axis in the direction towards the inlet and outlet ports in the housing. This bias is accomplished by means of a compression spring which is positioned on a support pin. This support pin extends in the axial direction of the cylinder barrel and is supported against an angled plate. The angled plate is rotatable together with the input/output shaft of the engine. The rotation of the cylinder barrel is synchronized with the rotation of the input/output shaft by means of synchronizing means such as a tooth gear transmission.

The end portion of the housing of the engine is removed and remounted when it is desirable that the rotational direction of the engine be reversed. This is accomplished by rotating the end portion of the housing approximately 180° such that the inlet and outlet ports shift positions. Such reversal is known from U. S. Pat. No. 4,934,253. When removing the end portion of the housing, the cylinder barrel is urged without control outwardly of the housing by means of the biasing force (spring), and can fall out of the housing if the engine is so positioned that the end portion is positioned downwardly of the housing. This results in that the engaging parts of the synchronizing means will come out of engagement with each other, which can cause problems when remounting the end portion of the housing. Further, the support pin can fall out of its position in the cylinder barrel and be loose when remounting the end portion of the housing.

SUMMARY OF THE INVENTION

The object of the present invention is to provide a hydraulic rotating axial piston engine of the above discussed type in which the cylinder barrel is prevented from coming out of its operating position when an end portion of the housing is removed. The present object is obtained by connecting the support pin at one end with the angled plate, and at the other end with the cylinder barrel.

The engine of the present invention has a housing enclosing a rotatable cylinder barrel. The cylinder barrel has a number of axial cylinders with a number of reciprocating pistons. The pistons reciprocate between two defined end positions, and cooperate with an angled plate in order to obtain the reciprocating movement. The cylinders have ports alternatingly acting as inlet and outlet ports, and the housing has at least one inlet and outlet channel. Each channel has a kidney-shaped port, facing towards the inlet and outlet ports of the cylinder barrel, and communicating with a number of the ports at the barrel. The cylinder barrel is rotatable relative to a first axis, which is inclined relative to a second axis of an input/output shaft. The angled plate is rotatable together with the input/output shaft around the second axis. The rotation of the cylinder barrel and the input/output shaft is synchronized by means of synchronizing means. The central support pin extends along the first axis between the angled plate and the cylinder barrel. The housing has at least two parts, one part of said housing positioning the input/output shaft and the second part including the kidney-shaped ports.

The second part of the housing including the kidney-shaped ports is removeable from the first part, and is remountable in a different rotational orientation relative to the first part such that the rotational direction of the engine can be reversed. To prevent the pin from falling out of the housing when the second part is removed, the pin has a spherical head at one end, which is received in a spherical recess in the angled plate; and a seat means at the other end which retains the other end of the pin within the cylinder base with only limited axial movement.

Further features of the present invention will become apparent to those skilled in the art upon reviewing the following specification and attached drawings.

DETAILED DESCRIPTION OF A PREFERRED EMBODIMENT

Figure 1:
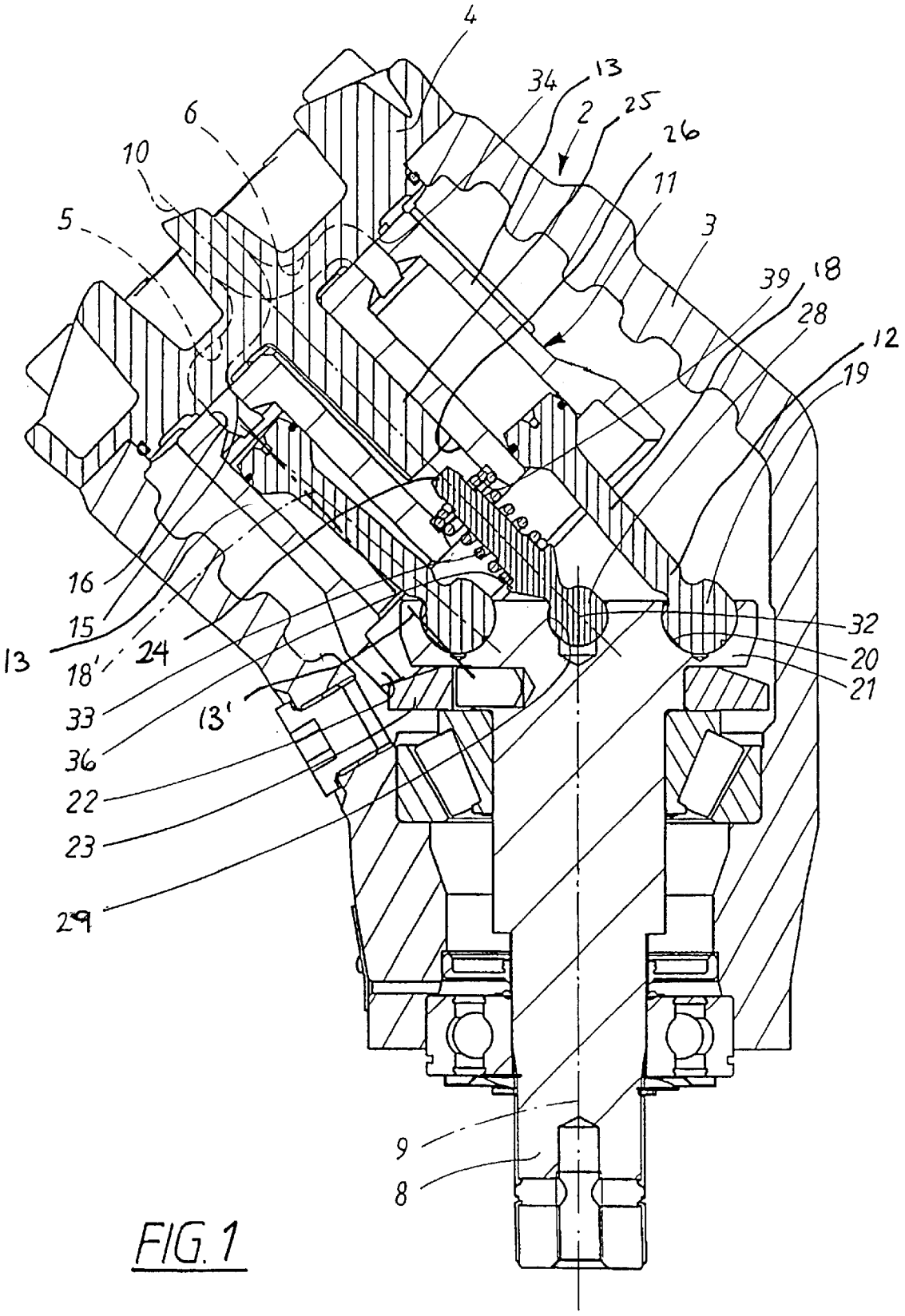
FIG. 1 is an axial section of a pump in a first embodiment according to the present invention.

A hydraulic rotating piston engine according to a preferred embodiment of the present invention is shown in FIG. 1. The pump is an axial piston pump 1 having a housing 2 which is comprised of at least two parts, namely a housing part 3 and a connecting part 4. The housing has connecting openings, namely an inlet opening 5 and an outlet opening 6 for connecting input and output conduits for hydraulic fluid to inlet and outlet channels in the connecting part of the pump. A part of the housing is a support part for the input shaft 8 which is connected with a drive motor, not shown. The pump is of a so called "bent axis" type, having a first rotational axis 9, forming a rotational axis for the input shaft 8, and a second rotational axis 10 inclined relative to the first axis by an angle of, for example 40°.

The second rotational axis 10 is an axis for a cylinder barrel 11 which is rotatably journalled in the housing. The cylinder barrel 11 has a number of pistons 12, movable substantially in parallel with the axis 10 in a reciprocating movement in a corresponding number of cylinders 13. Cylinders 13 extend axially with the axis 10, and are circumferentially equally spaced along a circle line. Each cylinder 13 has a fluid passage 15 with a port 16 in the planar end surface 17 of the cylinder barrel 11. Each port 16 has preferably its largest length along the peripheral circle line 14 and is preferably kidney-shaped. The ports 16 may also be circular.

From FIG. 1 it is further apparent that each piston 12 has a piston rod 18 with a spherical head 19. The heads 19 are supported in spherical bearing surfaces, which form recesses 20 in an angled plate 21. Plate 21 forms an integral part of the input shaft 8. The spherical recesses 20 are rotatably arranged around a radial plane which is angled relative to the radial plane of the cylinder barrel 11. This provides reciprocating movement of the pistons 12 and the pumping action according to prior known principles, in order to create vacuum i.e., suction, in the inlet opening 5 and pressure in the outlet opening 6 (see for example U.S. Pat. No. 5,176,066).

Synchronizing means are arranged in order to synchronize the rotational movements of the cylinder barrel with the rotation of the angled plate 21. In the shown example the synchronizing means is made in the form of a tooth gear formed by a tooth wheel rim 22 on the cylinder barrel cooperating with a tooth wheel 23 of the input shaft 8.

A support pin 24 supports the cylinder barrel 11 along the axis 10. Support pin 24 cooperates with a shaft 25 which forms the rotational axis 10 and projects through a bore 26 of the cylinder barrel.

As mentioned above, the cylinders 13 extend with their longitudinal axis 13' axially, i.e. in parallel, with the rotational axis 10 of the cylinder barrel 11. However, it is apparent from FIG. 1 that the longitudinal axis 18' of each piston rod 18 will deviate from the longitudinal axis 13' of the cylinder in which the piston rod performs a reciprocating movement. The longitudinal axis 18' is also the symmetrical axis of each piston, which together with its rod will be inclined in each cylinder 13. This inclination depends on the fact that the bearing surfaces 20 are arranged along a circle line in the angled plate 21. As the cylinder barrel 11 and the cylinders 13 are inclined relative to the angled plate 21, the spherical heads 19 perform an elliptic movement as seen along the rotational axis 10. This results in conical movements of the piston rods, and in turn results in a contribution to the total synchronization torque.

Figure 1A:
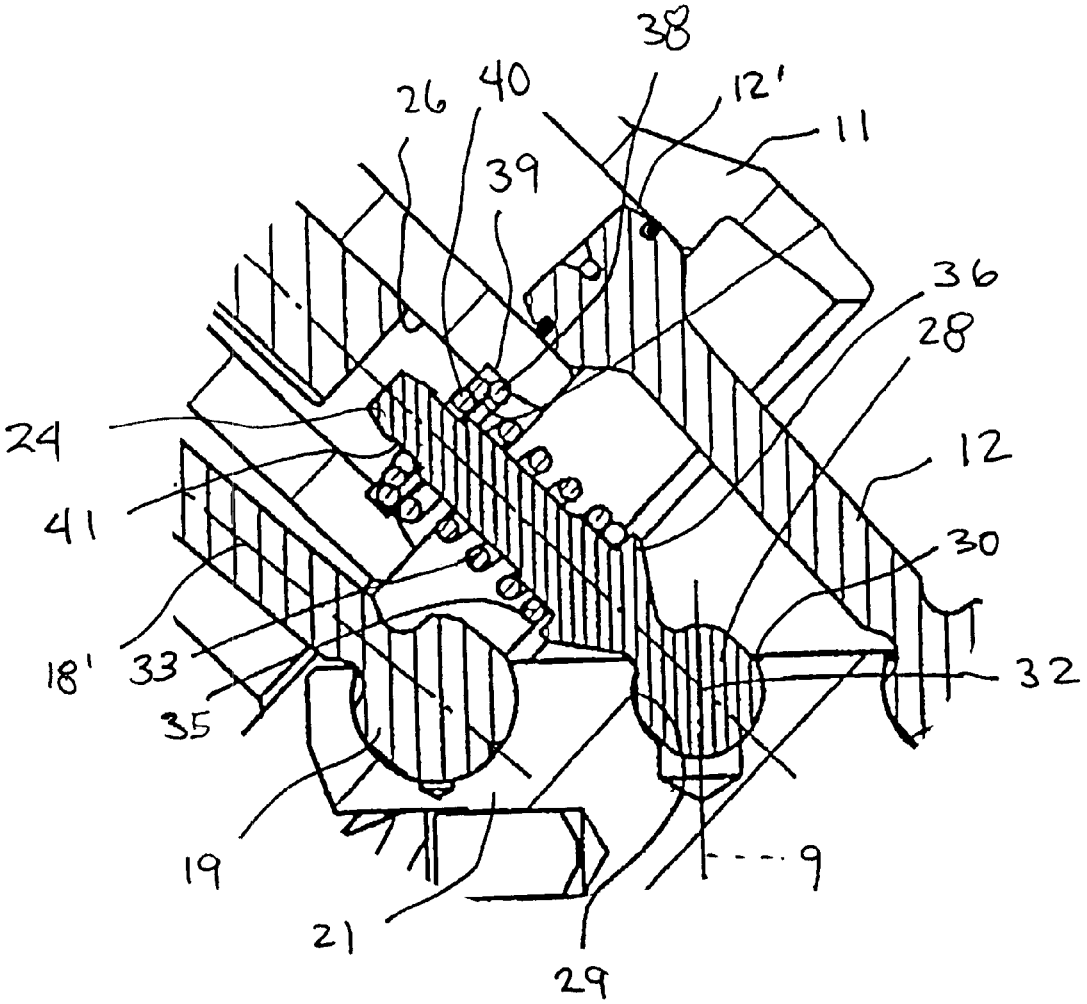
FIG. 1A is an enlarged detail section of a portion of the pump of FIG. 1.

As seen in Figure 1A, the pistons 12 are shaped with a conical surface 12' having an inclination somewhat greater than the conical inclination of the piston axis 18'. By means of the conical shape of the piston the inclination of the piston in the cylinder barrel 11 will be limited. This limits the rotation of the cylinder barrel 11 relative to the angled plate when the connecting part 4 of the housing 2 is removed. The conical shape will thereby eliminate the risk of incorrect synchronization between the tooth wheels of the synchronization means.

The support pin 24 is at one end 28 given the same shape as the spherical piston heads 19, namely shaped as substantially as a spherical head journalled in a spherical recess 29 in the center of the angled plate 21. This connection is prior known from, for example, EP-A1-0 567 805, and secures the support pin with its end, distant from the cylinder barrel 11, retained in the angled plate. The spherical recess 29 has in the shown example a spherical curvature as seen in the axial section, exceeding 180°, i.e. more than a semicircle. Consequently, the spherical recess 29 has a circular opening 30 having a diameter less than the diameter of the spherical recess 29. The spherical head 28 is provided with a cylinder mantle surface 31 (see, e.g., FIG. 7) having a diameter less than the diameter of the opening 30, enabling the head to be mounted into the recess, provided that the support pin 24 substantially extends in the direction of the second axis 9. However, in the mounted position according to FIG. 1, inclined relative to the axis 9, the support pin is retained and journalled in the spherical recess 29 of the angled plate 21. The center of curvature of the spherical head 28 coincides with a cross point 32 between the first axis 9 and second axis 10.

The support pin 24 is provided with a spring 33 which is compressed between the support pin 24 and the cylinder barrel 11, thereby biasing the cylinder barrel towards the connecting part 4 of the housing 2. The inlet opening 5 and outlet opening 6 are provided with an inlet port and outlet port, not shown, faced inwards in the connecting part 4 and positioned in a planar surface 34, against which the planar end surface 17 of the cylinder barrel is biased by means of spring 33. By means of this biasing force the ports 16 during rotation of the cylinder barrel can transport hydraulic fluid with a sealing fit when they are brought consecutively in communication with the ports in the connecting part 4.

Referring again to FIG. 1A, the spring 33 is at one end 35, distant from the cylinder barrel, supported by a spring seat 36 formed by a step in the support pin 24.

In the other end 38, the spring is retained in a seat 39 in the cylinder barrel 11. In the example as shown, this seat 39 is an annular groove in the cylinder bore 26 of the cylinder barrel. It is apparent from the drawings that the spring is specially designed with a first portion having larger diameter than the diameter of the cylinder bore 26 resulting in that the spring end 38 is retained in the seat. Further, the spring end 38 has a second portion 40 which has a diameter less than the diameter of spring opposite to this end. This second portion 40 of the spring encloses a recess 41 in the support pin, limiting the axial movement of the spring relative to the support pin in this end of the support pin.

Figure 2:
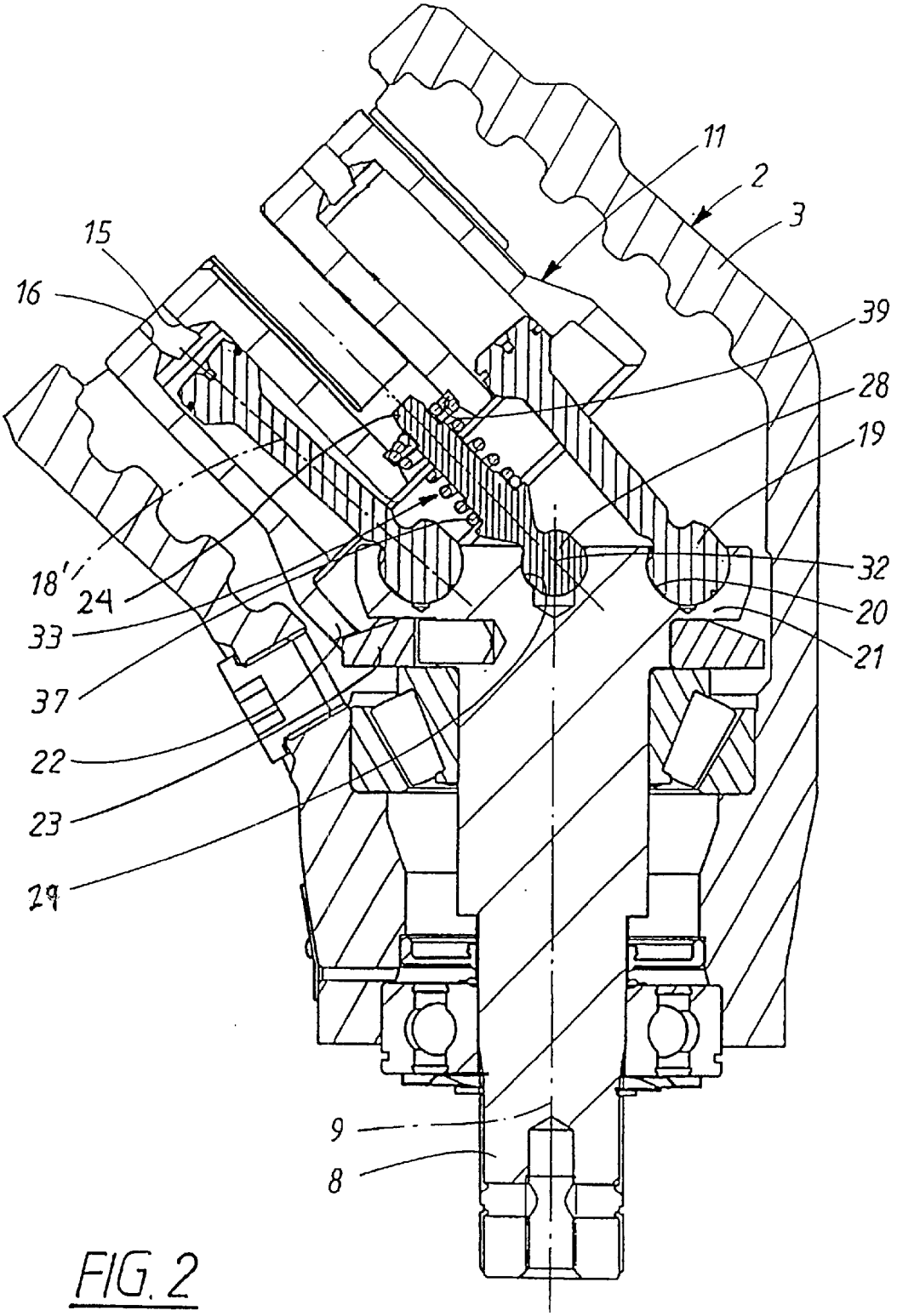
FIG. 2 is a corresponding section, but having a connecting part of the housing removed.

By means of the recess 41, the axial movement of the spring is limited, which is apparent from FIG. 2.

FIG. 2 further shows an axial section of the pump in which the connecting part 4 is removed from the housing part 2. This is accomplished by unscrewing screws (not shown) which for example are four in number, extending through holes in the connecting part 4 and screwed into threaded holes in the housing part 2. The connecting part 4 can be removed for the purpose of remounting the connecting part rotated approximately 180° in order to shift the positions of the inlet and outlet openings 5, 6. By means of this rotation, the same pump can operate with its input shaft rotating clockwise or counter clockwise. However, due to the biasing force of the spring 33, the cylinder barrel 11 is pressed axially outwards when the connecting part 4 is removed. Due to the present invention the axial movement is severely limited, in the shown example, on the order of a millimeter. This axial movement is determined by the axial length of the recess 41 of the supporting pin 24, enabling the spring in its end proximate to the cylinder barrel 11 to move axially this short extent. This end of the spring must be movable in order to subject the cylinder barrel to the biasing force, but according to the present invention this movement is severely limited.

Consequently, the support pin 24 will in one end be connected with the angled plate 21 and in its other end connected with the cylinder barrel 11. In the example according to FIGS. 1, 1A and 2, the connection between the support pin and the cylinder barrel will be secured by means of a special design of the spring itself, which in its end will connect the pin with the cylinder barrel and enable an axial movement within a short range.

Figure 3:
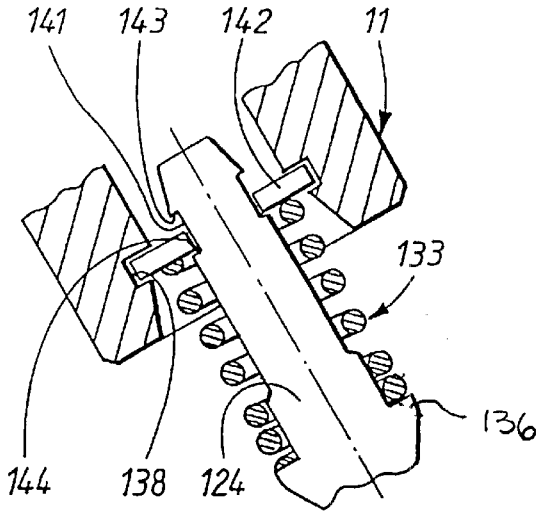
FIG. 3 show is an enlarged detailed section of a portion of the pump of the present invention according to a second embodiment, with the pin in one orientation.
Figure 4:
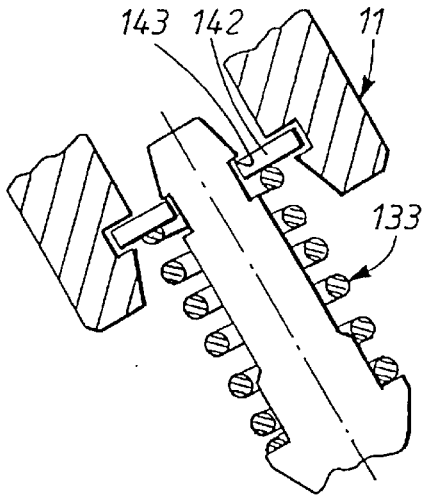
FIG. 4 is an enlarged detailed section similar to FIG. 3, with the pin in another orientation.

FIGS. 3 and 4 show a second embodiment in which a standard helical spring 133 can be utilized. In this embodiment, the spring 133 is retained at one end in the same manner as in the first embodiment, namely in a fixed seat 136 of the support pin 124. At the other end of the spring, the seat means is accomplished in the shape of a retaining washer 142, which also connects the support pin with the cylinder barrel. The cylinder barrel can have an annular groove 138, securing the washer against axial movement relative to the cylinder barrel. The radially inner portion of the washer 142 cooperates with the recess 141 of the support pin as in the first embodiment. By means of this recess 141, the seat means, i.e., the retaining washer 142, is axially movable relative to the support pin within a short range, enabling a relative movement between two stop surfaces 143, 144 which axially limits the extension of the recess 141.

In the position as shown in FIG. 3, the retaining washer 142 is axially positioned distant from the stop surface 143 (and not in contact with the other surface 144) involving that the spring 133 by means of the washer 142 transfers a biasing force to the cylinder barrel in a position of operation, when the connecting part 4 of the housing 2 is mounted, as shown in FIG. 1.

When the connecting piece 4 is removed, the cylinder barrel will be slightly displaced axially outwardly, due to the removal of the counter-acting force from the connecting portion (as shown in FIG. 4). Due to the action of the biasing force, the spring 133 is allowed to move the combined seat means and connecting means, namely the retaining washer 142, axially to the stop surface 143. This axial movement is severely limited, resulting in an insignificant axial movement of the cylinder barrel.

The retention of the support pin 124 at both ends, results in a retention of the cylinder barrel relative to the angled plate 21, ensuring that the synchronizing means will not come out of engagement during removal of the connecting part 4.

Figure 5:
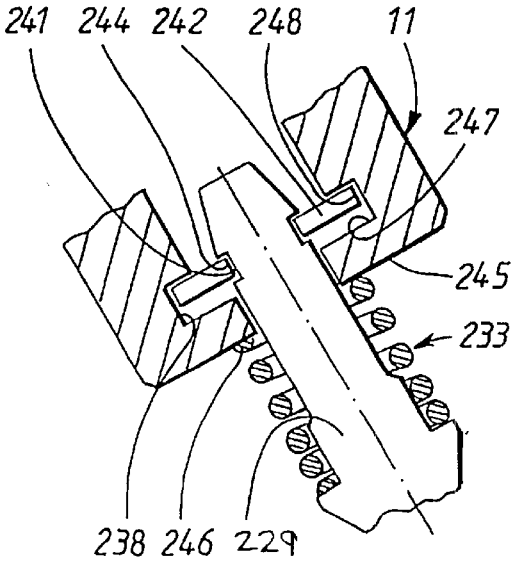
FIG. 5 is an enlarged detailed section of a portion of the pump of the present invention according to a third embodiment with the pin in one orientation.
Figure 6:
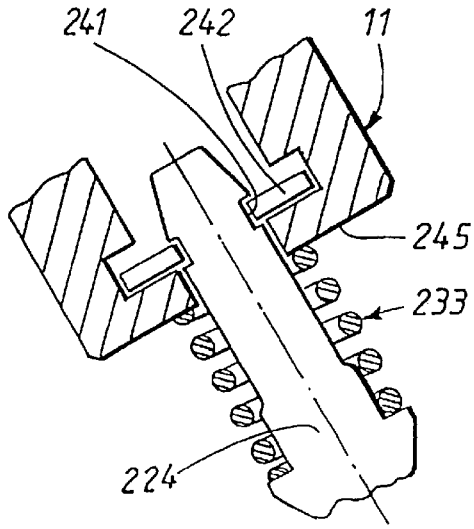
FIG. 6 is an enlarged detailed section similar to FIG. 5, with the pin in another orientation.

In the third embodiment as shown in FIGS. 5 and 6, the seat means of the cylinder barrel is separated from the connecting means between the support pin 224 and the cylinder barrel. In this embodiment, the compression spring 233 in the form of a helical spring is seated directly to a seat surface 245 of the cylinder barrel. This seat surface 245 projects radially inwards within the circumference of the spring coils 246 at the end of the spring at the cylinder barrel. In this embodiment, the connecting means is still a retaining washer 242 which connects the support pin 224 with the cylinder barrel with a predetermined axial clearance.

In this embodiment, the retaining washer 242 is substantially axially fixed to the support pin at the radially inner portion 244 of the washer. Further, the recess 241 has an axial extension which is dimensioned to substantially lock the washer axially. Instead, the annular groove 238 in the cylinder barrel 11 has an axial extension exceeding the thickness of the washer. This enables the washer to move axially within a very limited range. In the operating position according to FIG. 5 when the connecting part 4 is mounted according to FIG. 1, the spring 233 presses the cylinder barrel 11 axially towards the inside of the housing, namely the inlet and outlet ports, which occurs as the washer 242 is distant from its stop surface 247, but should not contact the opposite stop surface 248. When the end part 4 of the housing is removed, the axial movement of the cylinder barrel is limited by means of the washer 242 due to its contact with the stop surface 247 with its radially outer portion and axial fixation to the support pin 224 by means of its radially inner portion 244, as shown in FIG. 6.

Figure 7:
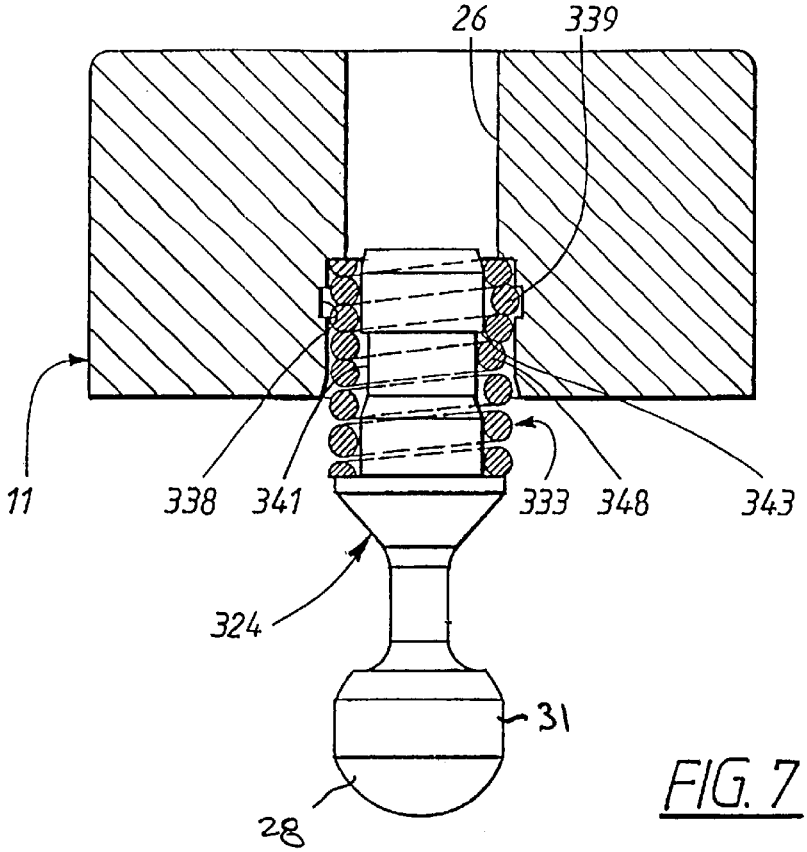
FIG. 7 is an enlarged detailed section of a portion of the pump of the present invention according to a fourth embodiment.

In a fourth embodiment as shown in FIG. 7, a coil turn 348 of the spring 333 is shaped with a reduced diameter at a middle portion of the spring. This coil turn 348 cooperates with a recess 341 of the support pin 324, said recess having a stop surface 343 for the coil turn when the connecting part 4 of the housing is removed.

As in the first embodiment, the spring 333 also has a coil turn 339 with increased diameter, which cooperates with a recess 338 in the bore 26 of the cylinder barrel 11 in order to form a seat for the spring. The arrangement shown in FIG. 7 will also result in a stabilized retaining of the cylinder barrel 11 when the connecting part 4 is removed.

Figure 8:
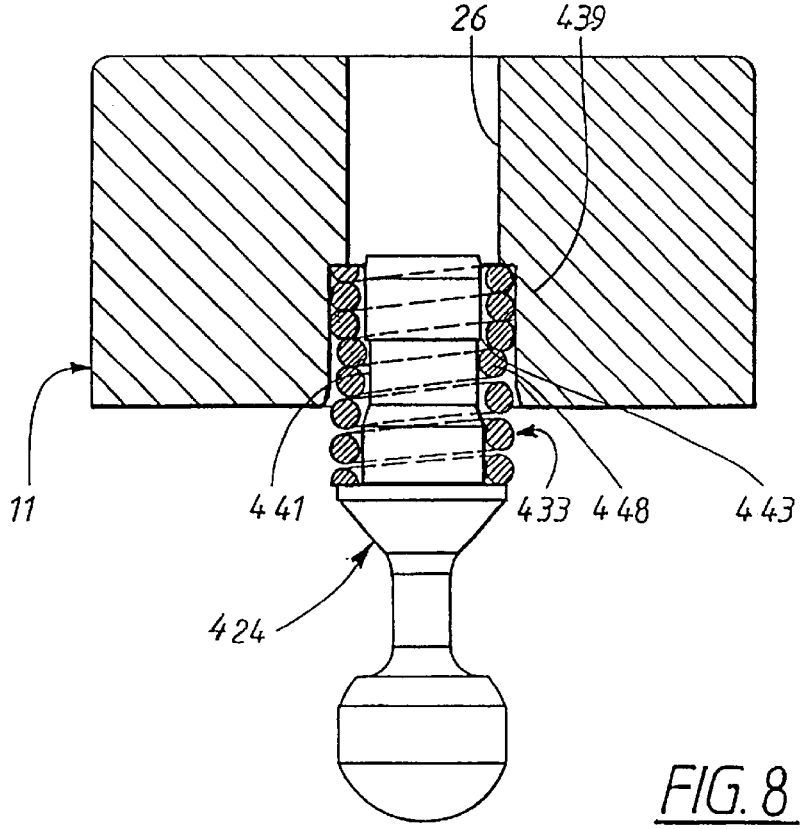
FIG. 8 is an enlarged detailed section of a portion of the pump of the present invention according to a fifth embodiment.

A fifth embodiment shown in FIG. 8 is of mainly the same type as the fourth embodiment of FIG. 7. However, in FIG. 8 the helical spring 433 is pressed against the cylindrical wall of the bore 26, which has a diameter less than the outer diameter of the spring in its free unloaded condition. The support pin 424 has a recess 441 with a stop surface 443 cooperating with a coil turn 448 where the coil turn 448 has a reduced diameter at a middle portion of the spring. This ensures that the spring retains the cylinder barrel 11 when the connecting part 4 of the housing is removed, but biases the barrel against the connecting part when mounted.

The invention is not limited to the embodiment as shown in the drawings and described above. For example the spring can be fixed to the cylinder barrel by means of shrink fit instead of a recess in the bore. The support pin can also be connected to the angled plate by other means. The engine can alternatively be a hydraulic motor, driven by pressurized hydraulic fluid and generating a torque at the rotatable output shaft 8, which is connected to an input shaft of a machine.

What is claimed is:

1. A hydraulic rotating axial piston engine comprising:

a housing enclosing a rotatable cylinder barrel, the cylinder barrel having a number of axial cylinders with a number of reciprocating pistons, with the pistons reciprocating between two defined end positions and cooperating with an angled plate in order to obtain the reciprocating movement, said cylinders having ports alternatingly acting as inlet and outlet ports, said housing having at least one inlet and outlet channel, each channel having a kidney shaped port, facing towards said inlet and outlet ports of said cylinder barrel, and communicating with a number of said ports at said barrel, said cylinder barrel being rotatable relative to a first axis, said first axis inclined relative to a second axis of an input/output shaft, said housing having at least two parts, one part of said housing positioning the input/output shaft and a second part including said kidney shaped ports, said angled plate being rotatable together with said input/output shaft around said second axis, the rotation of said cylinder barrel and said input/output shaft being synchronized by means of synchronizing means, a central support pin extending along said first axis between said angled plate and said cylinder barrel, said support pin at one end axially connected with said angled plate and in the other end axially connected to said cylinder barrel, said support pin limiting axial movement of the cylinder barrel relative to the angled plate, but allowing rotation of the cylinder barrel relative to the angled plate.

2. The hydraulic rotating axial piston engine as in claim 1, wherein said support pin is provided with a spring, said spring extending between the support pin and the cylinder barrel in order to bias the cylinder barrel axially towards the kidney shaped ports of the housing, said support pin provided with connecting means connecting the cylinder barrel axially with the support pin, and allowing said limited axial movement of the cylinder barrel under the bias of the spring to a stop surface.

3. The hydraulic rotating axial piston engine as claim 1, wherein said synchronizing means is a tooth gear synchronizing means.

4. The hydraulic rotating axial piston engine as in claim 3, wherein said pistons are shaped with a conical surface.

5. The hydraulic rotating axial piston engine as in claim 2, wherein said stop surface is a part of a recess in the support pin.

6. The hydraulic rotating axial piston engine as in claim 2, wherein said spring is a helical spring.

7. The hydraulic rotating axial piston engine as in claim 5, wherein said spring is connected with a recess in a central bore of the cylinder barrel, said bore receiving part of the support pin.

8. The hydraulic rotating axial piston engine as in claim 5, wherein an inner part of the spring is pressed within the wall of a central bore of the cylinder barrel, said bore receiving part of the support pin.

9. The hydraulic rotating axial piston engine as in claim 6, wherein an inner part of the spring is pressed within the wall of a central bore of the cylinder barrel, said bore receiving part of the support pin.

10. The hydraulic rotating axial piston engine as in claim 2, wherein the second part of the housing is rotatable approximately 180° relative to the first part.

11. A hydraulic rotating axial piston engine comprising:

a housing enclosing a rotatable cylinder barrel, the cylinder barrel having a number of axial cylinders with a number of reciprocating pistons, with the pistons reciprocating between two defined end positions and cooperating with an angled plate in order to obtain the reciprocating movement, said cylinders having ports alternatingly acting as inlet and outlet ports, said housing having at least one inlet and outlet channel, each channel having a port, facing towards said inlet and outlet ports of said cylinder barrel, and communicating with a number of said ports at said barrel, said cylinder barrel being rotatable relative to a first axis, said first axis inclined relative to a second axis of an input/output shaft, said housing having at least two parts, one part of said housing positioning the input/output shaft and a second part including said channel ports, said angled plate being rotatable together with said input/output shaft around said second axis, said rotation of said cylinder barrel and said input/output shaft being synchronized by synchronizing means, a central support pin extending along said first axis between said angled plate and said cylinder barrel, said support pin at one end axially connected by first connecting means to said angled plate and at the other end axially connected by second connecting means to said cylinder barrel, said second connecting means limiting axial movement of the cylinder barrel relative to the angled plate, but allowing rotation of the cylinder barrel relative to the angled plate.

12. The hydraulic rotating axial piston engine as in claim 11, wherein said support pin is provided with a spring, said spring extending between the support pin and the cylinder barrel in order to bias the cylinder barrel axially towards the channel ports of the housing, the second connecting means allowing said limited axial movement to a stop surface.

13. The hydraulic rotating axial piston engine as in claim 12, wherein said stop surface is a part of a recess in the support pin.

14. The hydraulic rotating axial piston engine as in claim 12, wherein said spring is a helical spring.

15. The hydraulic rotating axial piston engine as in claim 12, wherein said spring is connected with a recess in a central bore of the cylinder barrel, said bore receiving part of the support pin.

16. The hydraulic rotating axial piston engine as in claim 12, wherein an inner part of the spring is pressed within the wall of a central bore of the cylinder barrel, said bore receiving part of the support pin.

17. The hydraulic rotating axial piston engine as in claim 12, wherein an inner part of the spring is pressed within the wall of a central bore of the cylinder barrel, said bore receiving part of the support pin.

18. A hydraulic rotating axial piston engine comprising:

a housing enclosing a rotatable cylinder barrel, the cylinder barrel having a number of axial cylinders with a number of reciprocating pistons, with the pistons reciprocating between two defined end positions and cooperating with an angled plate in order to obtain the reciprocating movement, said cylinders having ports alternatingly acting as inlet and outlet ports, said housing having at least one inlet and outlet channel, each channel having a port, facing towards said inlet and outlet ports of said cylinder barrel, and communicating with a number of said ports at said barrel, said cylinder barrel being rotatable relative to a first axis, said first axis inclined relative to a second axis of an input/output shaft, said housing having at least two parts, one part of said housing positioning the input/output shaft and a second part including said channel ports, said angled plate being rotatable together with said input/output shaft around said second axis, said rotation of said cylinder barrel and said input/output shaft being synchronized by synchronizing means, a central support pin extending along said first axis between said angled plate and said cylinder barrel, said support pin at one end axially retained by said angled plate and at the other end axially connected by a connecting device to said cylinder barrel, said connecting device limiting axial movement of the cylinder barrel relative to the angled plate, but allowing rotation of the cylinder barrel relative to the angled plate.

* * * * *